US005288445A

United States Patent [19]

Tani et al.

[11] Patent Number: 5,288,445

[45] Date of Patent: Feb. 22, 1994

[54] RAPID HEAT-TREATMENT METHOD FOR POLYBENZAOLE FIBER

[75] Inventors: Katsuya Tani, Shiga, Japan; Steven Rosenberg, Midland, Mich.; Willard E. Alexander, Midland, Mich.; Chieh-Chun Chau, Midland, Mich.

[73] Assignee: The Dow Chemical Company, Midland, Mich.

[21] Appl. No.: 985,068

[22] Filed: Dec. 3, 1992

[51] Int. Cl.[5] ..... D01D 10/02; D01F 6/26

[52] U.S. Cl. ..... 264/85; 264/211.17; 264/345

[58] Field of Search ..... 264/85, 211.17, 345

[56] References Cited

U.S. PATENT DOCUMENTS

| | | | |
|---|---|---|---|
| 3,584,104 | 6/1971 | Bohrer et al. | 264/344 X |
| 3,619,453 | 11/1971 | Riggs | 264/344 X |
| 3,816,581 | 6/1974 | Prince, Jr. | 264/233 |
| 3,849,529 | 11/1974 | Ferment et al. | 264/85 |
| 3,883,718 | 5/1975 | Ferment et al. | 264/345 X |
| 4,419,317 | 12/1983 | Fujiwara et al. | 264/184 |
| 4,554,119 | 11/1985 | Chenevey | 264/85 |
| 4,581,437 | 4/1986 | Mammone | 264/345 X |

OTHER PUBLICATIONS

Abstract of Japan 2-84,509, published Mar. 26, 1990.
Abstract of Japan 2-84,510, published Mar. 26, 1990.
Abstract of Japan 2-84,511, published Mar. 26, 1990.
Abstract of Japan 3-104,920, published May 1, 1991.
Abstract of Japan 3-104,921, published May 1, 1991.
Abstract of Japan 4-194,022, published Jul. 14, 1992.
U.S. patent application Ser. No. 07/985,060, filed Dec. 3, 1992.
U.S. patent application Ser. No. 07/985,067, filed Dec. 3, 1992.
U.S. patent application Ser. No. 07/985,078, filed Dec. 3, 1992.
U.S. patent application Ser. No. 07/985,079, filed Dec. 3, 1992.
U.S. patent application Ser. No. 07/985,080, filed Dec. 3, 1992.
Encyclopedia of Polymer Science and Engineering, vol. 11, Peroxy Compounds to Polyesters "Polybenzimidazoles" pp. 572-600, copyright 1988 by John Wiley & Sons Inc.
Encyclopedia of Polymer Science and Engineering, Second Edition, vol. 11, "Polybenzothiazoles and Polybenzoxazoles", by James F. Wolfe, pp. 601-635 (undated).

*Primary Examiner*—Leo B. Tentoni
*Attorney, Agent, or Firm*—Margaret M. Brumm

[57] ABSTRACT

This invention aims at improvement of heat-treatment technology for manufacture of large amounts of polybenzazole fibers. The fibers are heat treated in a device that provides for a rapid, cocurrent, countercurrent or both cocurrent and countercurrent flow of heat treatment gas.

10 Claims, No Drawings

RAPID HEAT-TREATMENT METHOD FOR POLYBENZAOLE FIBER

BACKGROUND OF THE INVENTION

This invention relates to a method of heat treating polybenzazole fibers in order to improve the physical properties of the fibers.

Polybenzazole fibers, such as polybenzoxazole fibers, are expected to be the super fibers of the next generation because they can have a modulus two or more times higher than the modulus of poly-p-phenyleneterephthalamide fiber which is representative of super fibers on the market now.

The best modulus for polybenzazole fiber is not obtained unless the fiber is heat-treated. Conventional heat treatment methods are described in *J. Mater. Sci.*, 20, 2727(1985) and H. D. Ledbetter, S. Rosenberg, C. W. Hurtig, *Symposium Proceedings of The Materials Science and Engineering of Rigid-Rod Polymers*, Vol. 134, 253 (1989). These conventional heat treatment processes for polybenzazole fibers must be conducted at temperatures of 500° C. or more since the rigidity of the polybenzazole molecule is very high. Conventional fiber heat-treating equipment tends to be expensive, and the amount of time required can lead to heat treating becoming the bottle neck of industrial fiber production.

Heat treating is required in order to improve the modulus of polybenzazole fibers. This invention provides a new method of heat treatment which eliminates the necessity for prolonged high temperature heat treatment of polybenzazole fibers. Polybenzazole ("PBZ") fibers include fibers made of polybenzoxazole ("PBO") or polybenzothiazole ("PBT").

SUMMARY OF THE INVENTION

One aspect of the invention is a method to heat treat a polybenzazole fiber by contacting the polybenzazole fiber under tension in a heat treating zone with a heating medium heating gas, characterized in that the heating medium heating gas moves through the heat treating zone in a cocurrent or countercurrent fashion with the fiber.

A second aspect of the invention is a method to heat treat a polybenzazole fiber by contacting the polybenzazole fiber under tension in a heat treating zone with a heating medium heating gas, characterized in that the heating medium heating gas moves through the heat treating zone in a cocurrent or countercurrent fashion with the fiber at a velocity of at least about 5 m/sec.

A third aspect of the invention is a method to heat treat a polybenzazole fiber by contacting the polybenzazole fiber under tension in a heat treating zone with a heating medium heating gas, characterized in that the heating medium heating gas moves through the heat treating zone in a cocurrent or countercurrent fashion with the fiber at a velocity of at least about 5 m/sec wherein the residence time of the fiber in the heat treating zone is no more than about 3 seconds.

DETAILED DESCRIPTION OF THE INVENTION

Polymers

The present invention uses shaped articles containing polybenzazole (polybenzoxazole and polybenzothiazole) polymers. Polybenzoxazole, polybenzothiazole and random, sequential and block copolymers of polybenzoxazole and polybenzothiazole are described in references such as Wolfe et al., *Liquid Crystalline Polymer Compositions, Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermooxidatively Stable Articulated p-Benzobisoxazole and p-Benzobisthiazole Polymers*, U.S. Pat. No. 4,359,567 (Nov. 16, 1982); Tsai et al., *Method for Making Heterocyclic Block Copolymer*, U.S. Pat. No. 4,578,432 (Mar. 25, 1986); 11 Ency. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989), which are incorporated herein by reference.

The polymer may contain AB-mer units, as represented in Formula 1(a), and/or AA/BB-mer units, as represented in Formula 1(b)

1(a)

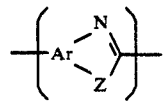

AB

1(b)

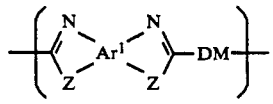

AA/BB wherein:

Each Ar represents an aromatic group. The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. Examples of suitable aromatic groups include phenylene moieties, tolylene moieties, biphenylene moieties and bis-phenylene ether moieties. $Ar^1$ in AA/BB-mer units is preferably a 1,2,4,5-phenylene moiety or an analog thereof. Ar in AB-mer units is preferably a 1,3,4-phenylene moiety or an analog thereof.

Each Z is independently an oxygen or a sulfur atom.

Each DM is independently a bond or a divalent organic moiety that does not interfere with the synthesis, fabrication or use of the polymer. The divalent organic moiety may contain an aliphatic group, which preferably has no more than about 12 carbon atoms, but the divalent organic moiety is preferably an aromatic group (Ar) as previously described. It is most preferably a 1,4-phenylene moiety or an analog thereof.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or trans-position with respect to each other, as illustrated in 11 Ency. Poly. Sci. & Eng., supra, at 602, which is incorporated herein by reference.

The polymer preferably consists essentially of either AB-polybenzazole mer units or AA/BB-polybenzazole mer units, and more preferably consists essentially of AA/BB-polybenzazole mer units. The molecular structure of the polybenzazole polymer may be rigid rod, semi-rigid rod or flexible coil. It is preferably rigid rod in the case of an AA/BB-polybenzazole polymer or semi-rigid in the case of an Ab-polybenzazole polymer. Azole rings within the polymer are preferably oxazole rings (Z=O). Units within the polybenzazole polymer are preferably chosen so that the polymer is lyotropic liquid-crystalline, which means it forms liquid-crystalline domains in solution when its concentration exceeds a "critical concentration point". Preferred mer units are illustrated in Formulae 2(a)–(h). The polymer more preferably consists essentially of mer units selected from those illustrated in 2(a)–(h), and most preferably consists essentially of a number of identical units selected from those illustrated in 2(a)–(c).

(a)

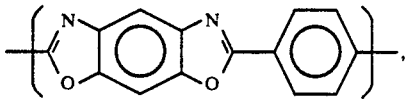

cis-polybenzoxazole Poly[benzo(1,2-d:5,4-d')bisoxazole-2,6-diyl-1,4-phenylene]

(b)

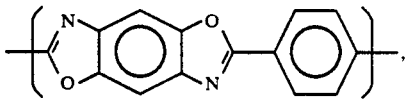

trans-polybenzoxazole Poly[benzo(1,2-d:4,5-d')bisoxazole-2,6-diyl-1,4-phenylene]

(c)

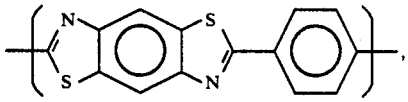

trans-polybenzothiazole (d)

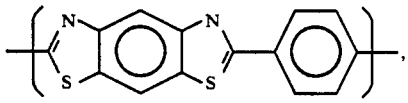

cis-polybenzothiazole (e)

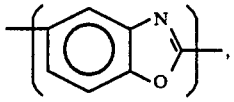

AB—PBO Poly(2,5-benzoxazole)

(f)

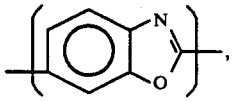

AB—PBO Poly(2,6-benzoxazole)

(g)

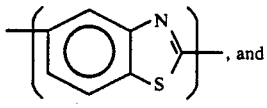

, and

Poly(2,5-benzothiazole)

-continued (h)

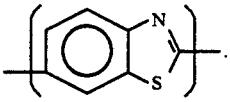

Poly(2,6-benzothiazole)

Each polymer preferably contains on average at least about 25 mer units, more preferably at least about 50 mer units and most preferably at least about 100 mer units. The intrinsic viscosity of lytropic liquid-crystalline AA/BB-polybenzazole polymers (as estimated by a single-point method in methanesulfonic acid at 25° C.) is preferably at least about 10 deciliters/gram ("dL/g"), more preferably at least about 15 dL/g, and most preferably at least about 20 dL/g. For some purposes, an intrinsic viscosity of at least about 25 dL/g or 30 dL/g may be best. Intrinsic viscosity of 60 dL/g or higher is possible, but the intrinsic viscosity is preferably no more than about 45 dL/g. The intrinsic viscosity is most preferably about 33 dL/g. The intrinsic viscosity of lyotropic liquid-crystalline semi-rigid AB-polybenzazole polymers is preferably at least about 5 dL/g, more preferably at least about 10 dL/g and most preferably at least about 15 dL/g.

The polymer is fabricated into fibers and films by spinning or extruding from a dope. A dope is a solution of polymer in a solvent. If freshly made polymer or copolymer is not available for spinning or extruding, the previously made polymer or copolymer can be dissolved in a solvent to form a solution or dope. Some polybenzoxazole and polybenzothiazole polymers are soluble in cresol, but the solvent is preferably an acid capable of dissolving the polymer. The acid is preferably non-oxidizing. Examples of suitable acids include polyphosphoric acid, methanesulfonic acid and sulfuric acid and mixtures of those acids. The acid is preferably polyphosphoric acid and/or methanesulfonic acid, and is more preferably polyphosphoric acid.

The dope should contain a high enough concentration of polymer for the polymer to coagulate to form a solid article but not such a high concentration that the viscosity of the dope is unmanageable to handle. When the polymer is rigid or semi-rigid, then the concentration of polymer in the dope is preferably high enough to provide a liquid cyrstalline dope. The concentration of the polymer is preferably at least about 7 weight percent, more preferably at least about 10 weight percent and most preferably at least about 14 weight percent. The maximum concentration is limited primarily by practical factors, such as polymer solubility and, as already described, dope viscosity. Because of these limiting factors, the concentration of polymer is seldom more than 30 weight percent, and usually no more than about 20 weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Ledbetter et al., "An Integrated Laboratory Process for Preparing Rigid Rod Fibers from the Monomers," *The Materials Science and Engineering of Rigid-Rod Polymers* at 253–64 (Materials Res. Soc. 1989), which are incorporated herein by reference. In summary, suitable monomers (AA-monomers and BB-monomers or AB-monomers) are reacted in a solution of nonoxidizing and dehydrating acid under nonoxidizing atmosphere with vigorous mixing and high shear at a temperature that is increased in step-wise or ramped fashion from a starting temperature of no more than about 120° C. to a final temperature of at least about 190° C. Examples of suitable AA-monomers include terephthalic acid and analogs thereof. Examples of suitable BB-monomers include 4,6-diaminoresorcinol, 2,5-diaminohydroquinone, 2,5-diamino-1,4-dithiobenzene and analogs thereof, typically stored as acid salts. Examples of suitable AB-monomers include 3-amino-4-hydroxybenzoic acid, 3-hydroxy-4-aminobenzoic acid, 3-amino-4-thiobenzoic acid, 3-thio-4-aminobenzoic acid and analogs thereof, typically stored as acid salts.

Preparation of PBO "Dope"

A PBZ dope is a solution of PBZ polymer in a solvent. Polybenzoxazole polymer is only soluble in very highly protic acid solvents such as methane sulfonic acid or polyphosphoric acid. A preferred solvent is polyphosphoric acid ("PPA"). The preferred concentration of PBO in the polyphosphoric acid is about 14 weight percent. The intrinsic viscosity of the PBO/PPA polymer dope should be in the range of 22 to 45 dL/g (based on measuring in a methane-sulfonic acid solution at 25° C. and a 0.05 g/dL concentration).

Preparation of Polybenzazole Fibers

These polybenzazole fibers are preferably made employing a so-called coupled process of polymerization and spinning, in which polybenzazole dope from the polymerization is supplied directly to a spinning part which includes orifices, without taking the spinning dope from the polymerization reaction equipment, although one may perform dry-spinneret-wet spinning type process separately, after taking the dope from the polymerization equipment.

In a dry-jet-wet-spinning process the dope is extruded from the orifices of the spinneret. The pattern of orifices on the spinneret can be in the shape of a circle or a lattice. The number of orifices and the arrangement of orifices in a spinneret needs to be selected to ensure that the dope fibers exiting the spinneret do not stick or fuse to each other. It is important to equalize the temperature of all the fibers exiting the spinneret because a difference in temperature among fibers of a fiber bundle is reflected in spinning tension difference immediately. (See copending, same-day filed U.S. Patent Application "Method for Rapid Spinning of a Polybenzazole Fiber" which is assigned to the same entity as this application and which is incorporated by reference.)

After exiting the orifices on the spinneret the dope fibers enter an "air gap". The gas in the "air gap" may be air, but it may also be another gas such as nitrogen, carbon dioxide, helium or argon. The temperature in the air gap is preferably between about 0° C. and 150° C., more preferably between about 0° C. and 100° C. and most preferably between 50° C. and 100° C. After being spun, the extruded dope fibers are contacted with a fluid known as a coagulant to separate the solvent from the polybenzazole polymer.

The coagulant can be in a bath or it can be sprayed onto the fibers. If a liquid medium coagulation bath is used it should be installed downward of the spinneret. The extraction of solvent at a level of more than 99.0 percent and more preferably of more than 99.5 percent is accomplished in this liquid medium coagulation bath. Any coagulation bath/spray used can contain water or water/acid mixtures, with the preferred acid being phosphoric acid at a concentration of 30 percent or less. Other coagulants for the fiber include organic solvents such as acetone, methanol or acetonitrile. Any kind of liquid medium coagulation bath system can be used, for example, very common solidification baths have a roller inside, or the funnel type bath mentioned in Japan laid open patent No. 51-35716, or the Japanese Patent Publication No. 44-22204, or the coagulation bath with high speed aspirator mentioned in U.S. Pat. No. 4,298,565 or waterfall type coagulation bath mentioned in U.S. Pat. No. 4,869,860.

The solvent concentration in the coagulated fiber decreases further by the washing of the fiber using a washing liquid. As before, any washing bath/spray used can contain water or dilute water/acid mixtures, with the preferred acid being phosphoric acid at a concentration of 5 percent or less. Other washing liquids for the fiber can include organic solvents such as acetone, methanol or acetonitrile.

After being coagulated and washed the fiber is dried and taken up on storage rolls. The fiber obtained in this way has sufficient tenacity and sufficient modulus for an as-spun fiber, but the modulus of this polybenzazole fiber can be improved dramatically by subsequent heat-treatment.

The heat treatment process can be conducted separately or continuously. Typical heat treatment apparati have the appearance of narrow tubes or rectangles with a means to deliver and take-up the fiber as it enters and exits the heat treatment apparatus. The heat treatment apparatus must also have a means for delivering a directed flow of heating medium heating gas relative to the fiber. The means to deliver a directed flow of heating medium heating gas to the fiber could provide a cocurrent directed flow of heating medium heating gas or a countercurrent directed flow of heating medium heating gas relative to the fiber.

It is also possible to have both countercurrent and cocurrent flow in a heat treatment apparatus, by having a delivery system in the center of the apparatus with this delivery system having two nozzles which can supply the heating medium heating gas simultaneously in both a cocurrent (with the fiber) direction and a countercurrent (against the fiber) direction.

High velocity and high temperature gas, such as steam, nitrogen or other inert gases, can be used as the heating medium heating gas for a heat treatment process in order to increase the modulus of polybenzazole as-spun fiber. The area in the heat treating apparatus where the fiber is in contact with the heating medium heating gas is referred to as the "heat treating zone". The velocity of the heating medium heating gas should be higher than at least 5 m/sec and preferably higher than 10 m/sec, because heat exchange efficiency between fibers and heating gas is determined by the velocity difference between fiber and gas as explained in the following equation.

$$\Delta T \propto L^{0.8} \cdot u^{0.8} \cdot t \cdot (Ts - Tf)$$

where L is length of heater or heat treating zone, u is velocity difference between fibers and gas, t is residence time of heater, Ts is temperature of gas and Tf is temperature of fibers before heater.

In order to enhance the heat exchange between the heating medium heating gas and the fiber, it is important that the heating medium heating gas be impelled into the heat treatment apparatus such that the flow of heating medium heating gas is directed at the fiber in either a cocurrent or countercurrent manner. With either cocurrent or countercurrent flow, there will be a velocity difference between the fiber and the heating medium heating gas with such velocity difference aiding in heat transfer efficiency. Of course, the velocity difference will be greater for countercurrent flow than for cocurrent flow.

The speed of the fibers through the heat treating zone is preferably at least about 20 m/min. and more preferably at least about 40 m/min. The velocity of the gas is preferably at least 5 m/sec. and most preferably at least 10 m/sec. The velocity difference between the fibers and the gas is preferably at least 5 m/sec and more preferably at least 10 m/sec. The gas flow rate is measured by a flow meter as mass in kg/hr. For a heat treatment apparatus which has both cocurrent and countercurrent flow of heating medium heating gas, the gas velocity is converted from flow rate by the following equation:

$$v = Q/d/60^2/2S$$

where v is velocity in m/sec, Q is mass flow rate in kg/hour, d is density of steam, and S is cross sectional area of steam heater in square meters. The residence time of the fibers in the heating zone is preferably at most 20 sec., more preferably at most 5 sec. and most preferably at most about 3 sec. The tension on the fibers is preferably between 0.1 and 10 g/den, although it may be more or less.

Through the instantaneous increase of temperature of fiber by the use of a high velocity and high temperature of fiber by the use of a high velocity and high temperature gas heating medium, the negative heat set effect during heat treatment can be reduced and as a result this improved heat treatment process can decrease the conventional temperature required (usually 600 degrees C.) and the conventional residence time required (more than 10 seconds). By using a directed, either cocurrent or countercurrent flow of a high velocity and high temperature gas in the heat treatment apparatus, the temperature required for heat treatment can be reduced down to 400° C. and the residence time for the fiber in the heat treatment process can be shortened to less than 3 seconds. The tensile modulus of the fibers heat treated by this method is preferably at least 220 GPa (31.9 msi) and more preferably at least about 250 GPa (36.3 msi).

The following examples are given as specific illustrations of the invention. It should be understood, however, that the invention is not limited to the specifics set forth in the examples.

EXAMPLE 1

A polybenzoxazole polymer dope (approximately 14 weight percent polymer) is created. Once created, this polymer dope is transferred through a wire mesh filter to a twin screw extruder in order to mix and degas. Then the spinning dope is extruded from a spinneret which has 334 orifices of 0.20 mm in diameter at 150 degrees C. Throughput of dope per orifice is 0.22 g/min. The extruded fibers are coagulated in a funnel type water coagulation bath which is 20 cm below the spinneret. The atmosphere in the twenty cm gap between the spinneret and the coagulation bath is dry air. The coagulated fibers are taken up at 200 m/min velocity. The coagulated fibers are then washed and dried. The dried fibers had 0.4 weight percent of moisture content, approximately 1110 g/d of modulus, 38.6 g/d of tenacity and 9.8 percent of elongation at break.

The dried fibers are heat treated under the specifications mentioned in Table 1. In the table, "SJ" stands for "Steam Jet", resid. is the residence time of the fiber in the heat treatment apparatus, GR1 is the feed roll and GR2 is the take-up roll.

TABLE 1

| | | | | Heat-Treated With Steam Jet | | | | | | | | |
|---|---|---|---|---|---|---|---|---|---|---|---|---|
| Sample # | Conv. Heater C. | SJ Temp. C. | SJ Velocity m/sec | GR1 m/min | GR2 m/min | Elong. % | Resid. sec | Stability | Den. d | Tena. g/d | E at Brake % | Mod g/d. |
| AS-SPUN | — | — | — | — | — | — | — | — | 206.8 | 38.6 | 3.8 | 1110 |
| Ref. 1 | 350 | none | — | 10.03 | 10.13 | 1.00 | 20.0 | Good | 207.0 | 38.1 | 3.5 | 1158 |
| Ref. 2 | 450 | none | — | 10.03 | 10.13 | 1.00 | 20.0 | Good | 206.3 | 36.6 | 2.9 | 1486 |
| Ref. 3 | 550 | none | — | 10.03 | 10.13 | 1.00 | 20.0 | Good | 205.8 | 34.8 | 2.5 | 1653 |
| Ref. 4 | 650 | none | — | 10.03 | 10.13 | 1.00 | 20.0 | Good | 206.0 | 36.1 | 2 | 1857 |
| Ref. 5 | 600 | none | — | 20.05 | 20.25 | 1.00 | 10.0 | Good | 205.4 | 36.5 | 2.9 | 1750 |
| Ref. 6 | 600 | none | — | 50.06 | 50.13 | 1.00 | 4.0 | Good | 205.3 | 35.7 | 3.1 | 1642 |
| Ref. 7 | 600 | none | — | 100 | 101 | 1.00 | 2.0 | Good | 206.5 | 37.2 | 3.1 | 1350 |
| 1 | none | 440 | 100 | 290 | 293 | 1.02 | 0.2 | Good | 206.9 | 36.7 | 2.8 | 1674 |
| 2 | none | 440 | 100 | 290 | 294 | 1.30 | 0.2 | Good | 207.5 | 37.6 | 2.7 | 1694 |
| 3 | none | 470 | 100 | 199 | 202 | 1.45 | 0.3 | Good | 199.7 | 38.0 | 2.3 | 1838 |
| 4 | none | 440 | 100 | 151 | 153 | 1.07 | 0.4 | Good | 205.0 | 33.3 | 2.2 | 1859 |
| 5 | none | 470 | 100 | 151 | 153 | 1.35 | 0.4 | Good | 207.2 | 36.5 | 2.3 | 1809 |
| 6 | none | 475 | 100 | 20.05 | 20.25 | 1.00 | 2.8 | Good | 205.3 | 33.0 | 2.0 | 1908 |
| 7 | none | 440 | 100 | 20.05 | 20.47 | 2.09 | 2.8 | Poor* | 199.0 | 30.8 | 1.8 | 1888 |
| 8 | none | 440 | 100 | 20.05 | 20.40 | 1.75 | 2.8 | Good | 206.1 | 32.9 | 1.9 | 1963 |
| 9 | none | 440 | 100 | 20.05 | 20.23 | 0.90 | 2.8 | Good | 204.7 | 32.5 | 2.1 | 1831 |
| 10 | none | 440 | 100 | 20.05 | 20.32 | 1.35 | 2.8 | Good | 203.4 | 35.4 | 2.1 | 1937 |
| 11 | none | 390 | 100 | 20.00 | 20.10 | 0.50 | 2.8 | Good | 205.0 | 33.3 | 2.2 | 1859 |
| 12 | none | 390 | 100 | 20.00 | 20.20 | 1.00 | 2.8 | Good | 209.0 | 34.7 | 2.0 | 1925 |
| 13 | none | 366 | 100 | 20.10 | 20.23 | 0.65 | 2.8 | Good | 204.0 | 34.5 | 2.6 | 1759 |
| 14 | none | 366 | 100 | 20.10 | 20.35 | 1.24 | 2.8 | Good | 206.7 | 34.3 | 2.2 | 1826 |
| 15 | none | 340 | 100 | 20.10 | 20.30 | 1.00 | 2.8 | Good | 207.3 | 34.3 | 2.4 | 1757 |
| 16 | none | 340 | 100 | 20.10 | 20.38 | 1.39 | 2.8 | Good | 205.1 | 35.3 | 2.3 | 1798 |
| 17 | none | 320 | 100 | 20.10 | 20.39 | 1.44 | 2.8 | Good | 206.2 | 35.1 | 2.4 | 1756 |
| 18 | none | 320 | 100 | 20.10 | 20.28 | 0.90 | 2.8 | Good | 205.9 | 35.8 | 2.7 | 1666 |
| 19 | none | 300 | 100 | 20.10 | 20.33 | 1.14 | 2.8 | Good | 207.2 | 36.9 | 2.8 | 1664 |
| 20 | none | 300 | 100 | 20.10 | 20.43 | 1.64 | 2.8 | Good | 204.6 | 37.3 | 2.6 | 1775 |
| 21 | none | 410 | 100 | 44.25 | 44.80 | 1.24 | 1.3 | Good | 203.8 | 34.8 | 2.3 | 1838 |
| 22 | none | 410 | 100 | 44.18 | 44.80 | 1.41 | 1.3 | Good | 205.2 | 35.5 | 2.2 | 1845 |

TABLE 1-continued

| Sample # | Conv. Heater C. | SJ Temp. C. | SJ Velocity m/sec | GR1 m/min | GR2 m/min | Elong. % | Resid. sec | Stability | Den. d | Tena. g/d | E at Brake % | Mod g/d. |
|---|---|---|---|---|---|---|---|---|---|---|---|---|
| | | | | Heat-Treated With Steam Jet | | | | | | | | |
| 23 | none | 410 | 100 | 44.03 | 44.45 | 0.95 | 1.3 | Good | 203.6 | 34.4 | 2.5 | 1701 |
| 24 | none | 460 | 10 | 44.03 | 44.45 | 0.95 | 1.3 | Good | 205.3 | 36.1 | 2.5 | 1654 |
| Ref. 8 | none | 410 | 5 | 44.03 | 44.45 | 0.95 | 1.3 | Good | 207.9 | 35.5 | 3.1 | 1320 |
| Ref. 9 | none | 410 | 1 | 44.03 | 44.45 | 0.95 | 1.3 | Good | 208.0 | 37.6 | 3.5 | 1149 |
| 25 | none | 460 | 100 | 20.14 | 20.34 | 0.99 | 2.8 | Good | 207.5 | 36.6 | 2.3 | 1860 |
| 26 | none | 460 | 100 | 20.14 | 20.49 | 1.44 | 2.8 | Good | 202.1 | 36.3 | 2.1 | 1972 |

*Fiber Broke and was fuzzy

In the case where the heating medium heating gas is steam, the sufficiently effective temperature is only 370 degrees C., as compared to the 600 degrees C. needed for conventional heat treatment. Further advantage for industrial manufacturing is that the line velocity of heat treatment can increase to higher than 200 m/min as compared with a line velocity of approximately 20 m/min using conventional means of heat treatment.

The measurement methods of physical-properties used for evaluation of the polybenzazole fibers are as follows.

LIMITING VISCOSITY NUMBER

The limiting viscosity number of polybenzobisoxazole polymers is measured by the zero extrapolation of the reduction viscosity measured at 30 degrees C. using methanesulfonic acid as a solvent.

DENIER OF FIBER

Samples of fiber are measured after being conditioned for 16 hours at 22 degrees C. and RH of 65+−2. Single fiber denier are measured by Denier Computer DC-I 1B type made by Search Co., Ltd. Fiber denier is measured by the wrap reel method according to JIS L-1013 (1981).

TENSILE PROPERTIES OF FIBERS

Measurement are performed according to JIS L-1013 (1981). Both a single fiber and a yarn are measured.

What is claimed is:

1. A method to heat treat a polybenzoxazole or polybenzothiazole fiber comprising contacting the polybenzoxazole or polybenzothiazole fiber under tension in a heat treating zone with a heating medium heating gas, with the heating medium heating gas moveing through the heat treating zone in a cocurrent or countercurrent fashion relative to the fiber.

2. The method as described in claim 1 wherein the heating medium heating gas moves through the heat treating zone relative to the fiber at a velocity of at least about 5 m/sec.

3. The method as described in claim 1 wherein the heating medium heating gas moves through the heat treating zone in a cocurrent fashion relative to the fiber.

4. The method as described in claim 1 wherein the heating medium heating gas moves through the heat treating zone in a countercurrent fashion relative to the fiber.

5. The method as described in claim 1 wherein there is a velocity difference between the heating medium heating gas and the fiber of at least 5 m/sec.

6. The method as described in claim 1 wherein the fiber has a residence time in the heat treating zone of no more than about 3 seconds.

7. The method as described in claim 1 wherein the heating medium heating gas is nitrogen.

8. The method as described in claim 1 wherein the polybenzoxazole or polybenzothiazole fiber is polybenzoxazole.

9. The method as described in claim 1 wherein the heating medium heating gas has a velocity of at least 10 m/sec.

10. The method as described in claim 1 wherein the heating medium heating gas has a velocity of at least 100 m/sec.

* * * * *